US009924850B2

(12) United States Patent
Park et al.

(10) Patent No.: US 9,924,850 B2
(45) Date of Patent: Mar. 27, 2018

(54) LOCK AND HOME APPLIANCE HAVING THE SAME

(71) Applicant: LG ELECTRONICS INC., Seoul (KR)

(72) Inventors: Jinhong Park, Seoul (KR); Mansu Park, Seoul (KR); Gabsik Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/398,213

(22) Filed: Jan. 4, 2017

(65) Prior Publication Data

US 2017/0188785 A1 Jul. 6, 2017

(30) Foreign Application Priority Data

Jan. 5, 2016 (KR) ..... 10-2016-0001256
Mar. 28, 2016 (KR) ..... 10-2016-0037156

(51) Int. Cl.

| | |
|---|---|
| ***A47L 15/00*** | (2006.01) |
| ***A47L 15/42*** | (2006.01) |
| ***A47B 96/00*** | (2006.01) |
| *E05C 1/12* | (2006.01) |
| *E05C 3/12* | (2006.01) |

(52) U.S. Cl.

CPC ..... *A47L 15/4259* (2013.01); *A47B 96/00* (2013.01); *A47L 15/4225* (2013.01); *E05C 1/12* (2013.01); *E05C 3/12* (2013.01)

(58) Field of Classification Search

CPC .. A47L 15/4259; A47L 15/4257; E05C 1/004; E05C 1/12; E05C 3/12; E05C 3/22

See application file for complete search history.

(56) References Cited

U.S. PATENT DOCUMENTS 6,761,381 B2 * 7/2004 Prada ..... A47L 15/4259 292/109
7,654,590 B2 * 2/2010 Hapke ..... A47L 15/4259 134/57 DL (Continued)

FOREIGN PATENT DOCUMENTS

EP 2450510 A2 5/2012
FR 2687718 A1 8/1993

(Continued)

*Primary Examiner* — Daniel J Rohrhoff
(74) *Attorney, Agent, or Firm* — Dentons US LLP

(57) ABSTRACT

A lock and a home appliance having the same are disclosed. The lock includes a holder provided at one selected from between a cabinet and a door, a housing provided at the other selected from between the cabinet and the door, a first stopper provided at the housing, an actuation unit configured to reciprocate in the housing, the actuation unit being moved away from the introduction port by the holder when the door to the introduction port is closed, a fastening unit supported by the first stopper, the fastening unit being separated from the first stopper and coupled to the holder when the actuation unit is moved away from the introduction port, a first elastic member for providing force necessary to move the fastening unit away from the introduction port, and a second elastic member for providing force necessary to move the actuation unit toward the introduction port.

19 Claims, 12 Drawing Sheets

(56) References Cited

U.S. PATENT DOCUMENTS

| | | | | |
|---|---|---|---|---|
| 2013/0234578 | A1* | 9/2013 | Ala | A47L 15/4259<br>312/326 |
| 2015/0275552 | A1* | 10/2015 | Unverdi | A47L 15/0049<br>292/341.18 |
| 2016/0251883 | A1* | 9/2016 | Wang | A47L 15/4259 |
| 2017/0067270 | A1* | 3/2017 | Lang | A47J 27/0804 |

FOREIGN PATENT DOCUMENTS

| | | | |
|---|---|---|---|
| JP | 2006-026405 | A | 2/2006 |
| KR | 20-1998-057010 | U | 10/1998 |
| KR | 10-0717470 | B1 | 5/2007 |
| KR | 10-2008-0002784 | A | 1/2008 |
| KR | 10-1549340 | B1 | 9/2015 |
| WO | 95/09958 | A1 | 4/1995 |

* cited by examiner

【Figure 1】
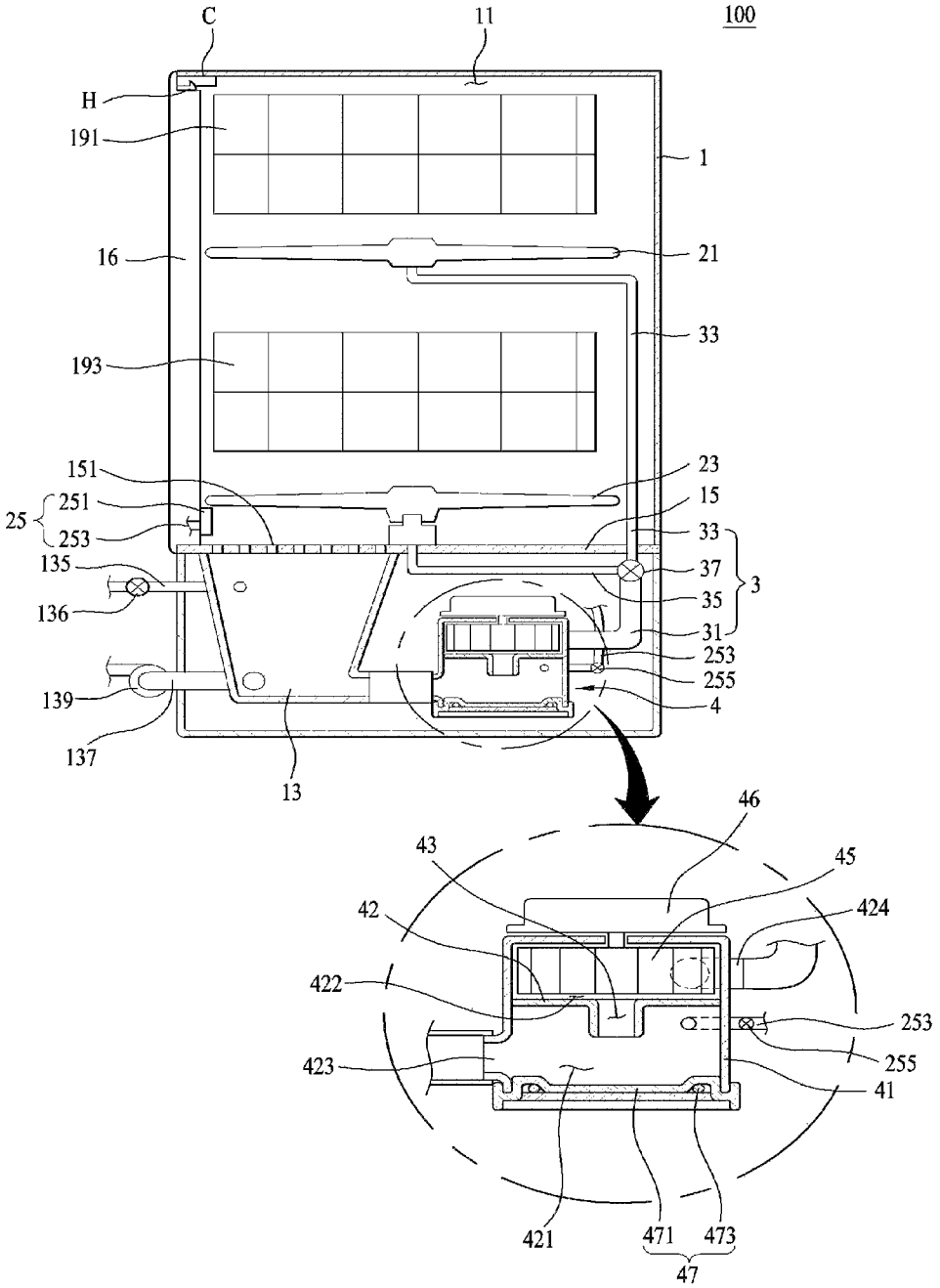

【Figure 2】
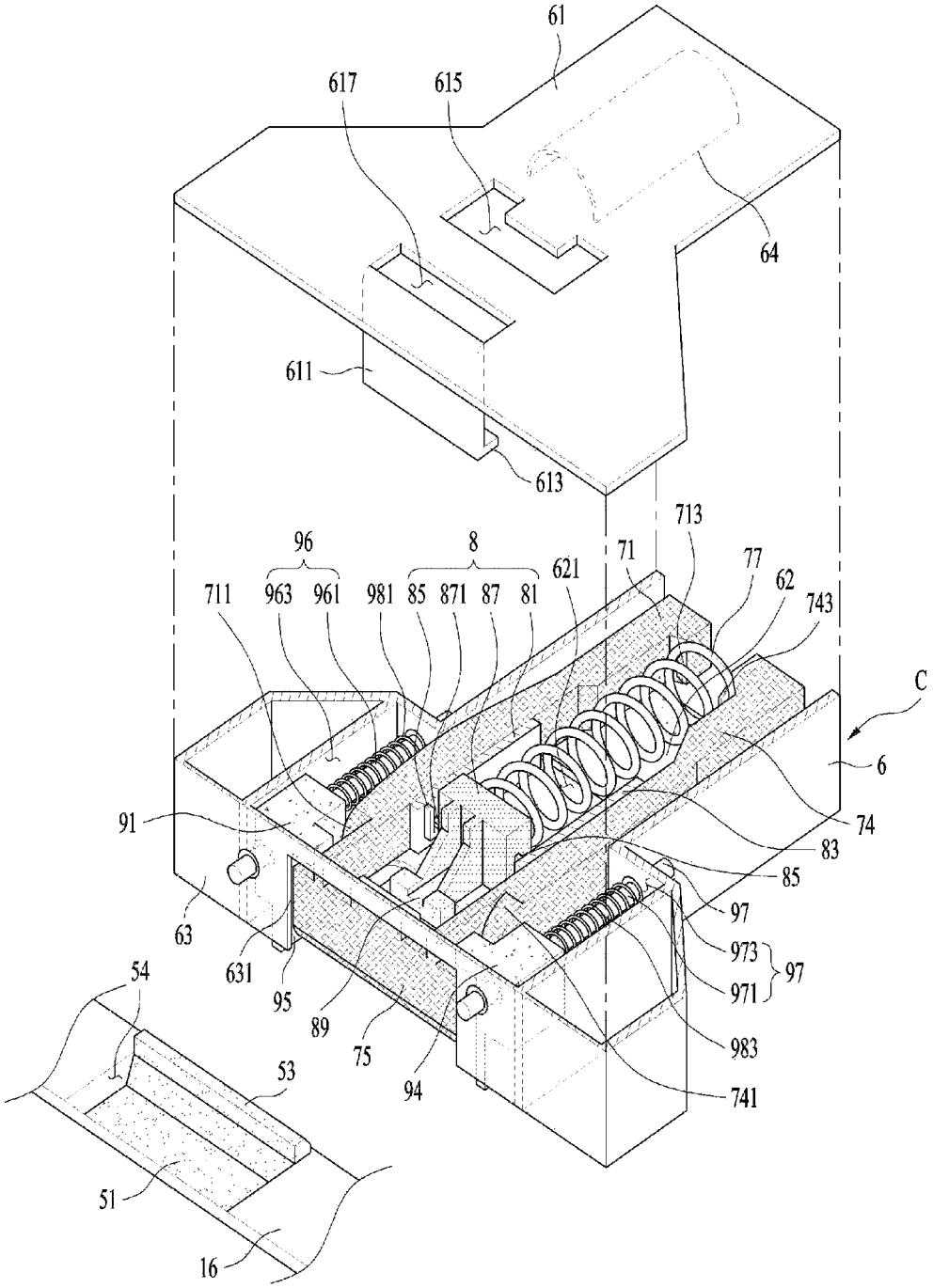

【Figure 3】
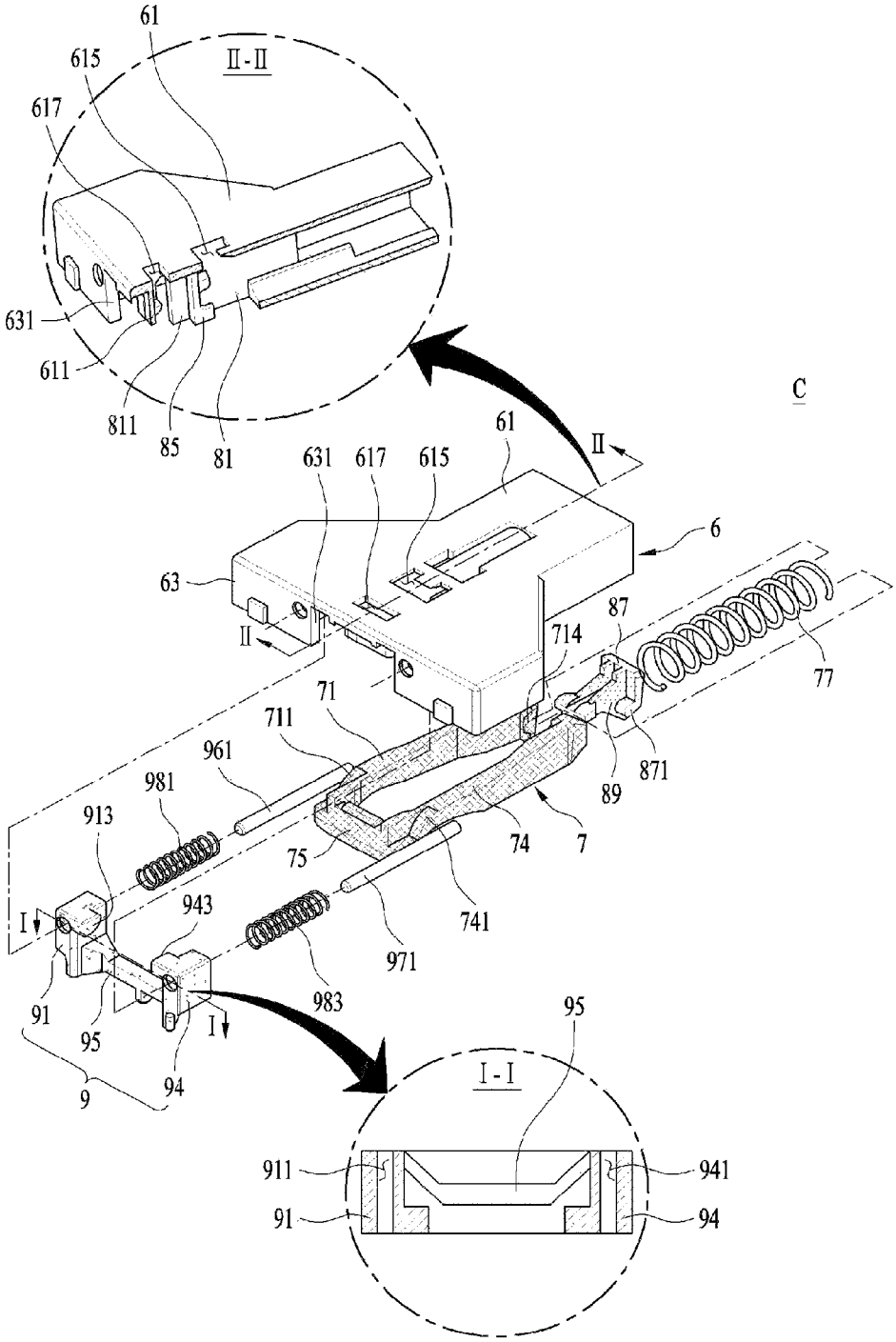

【Figure 4】
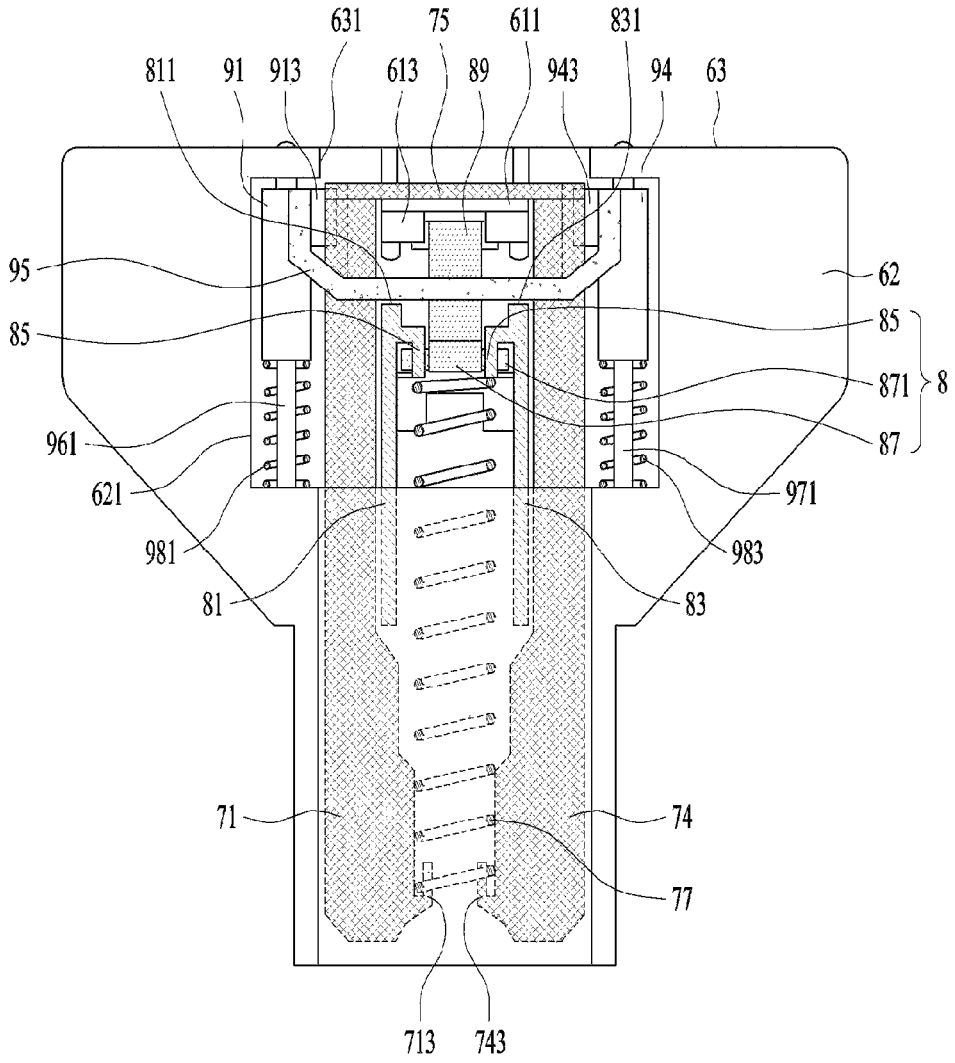

【Figure 5】
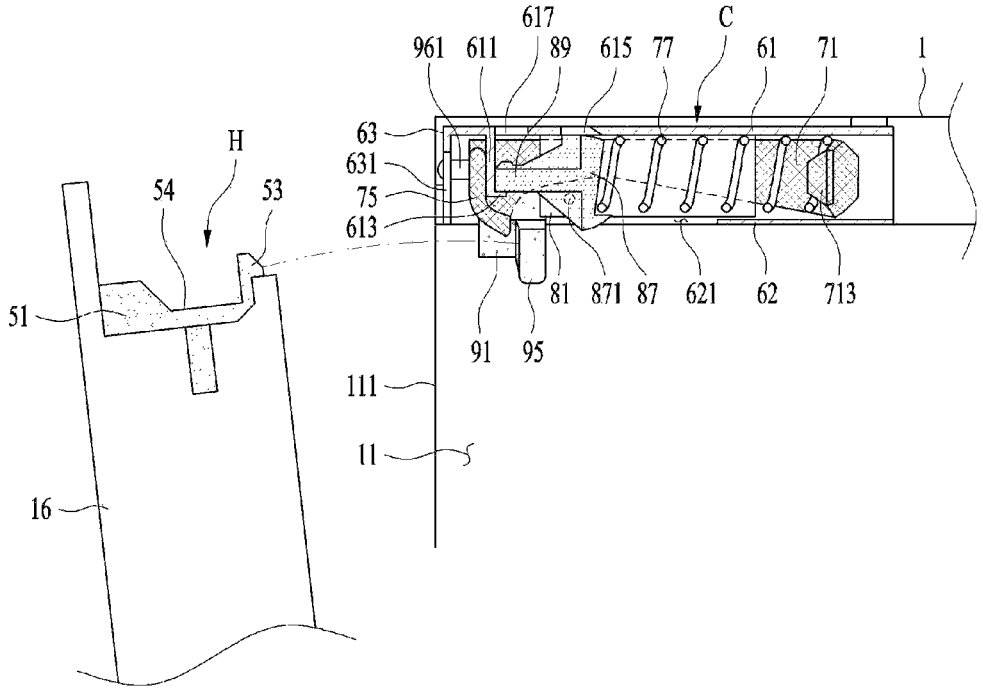

【Figure 6】
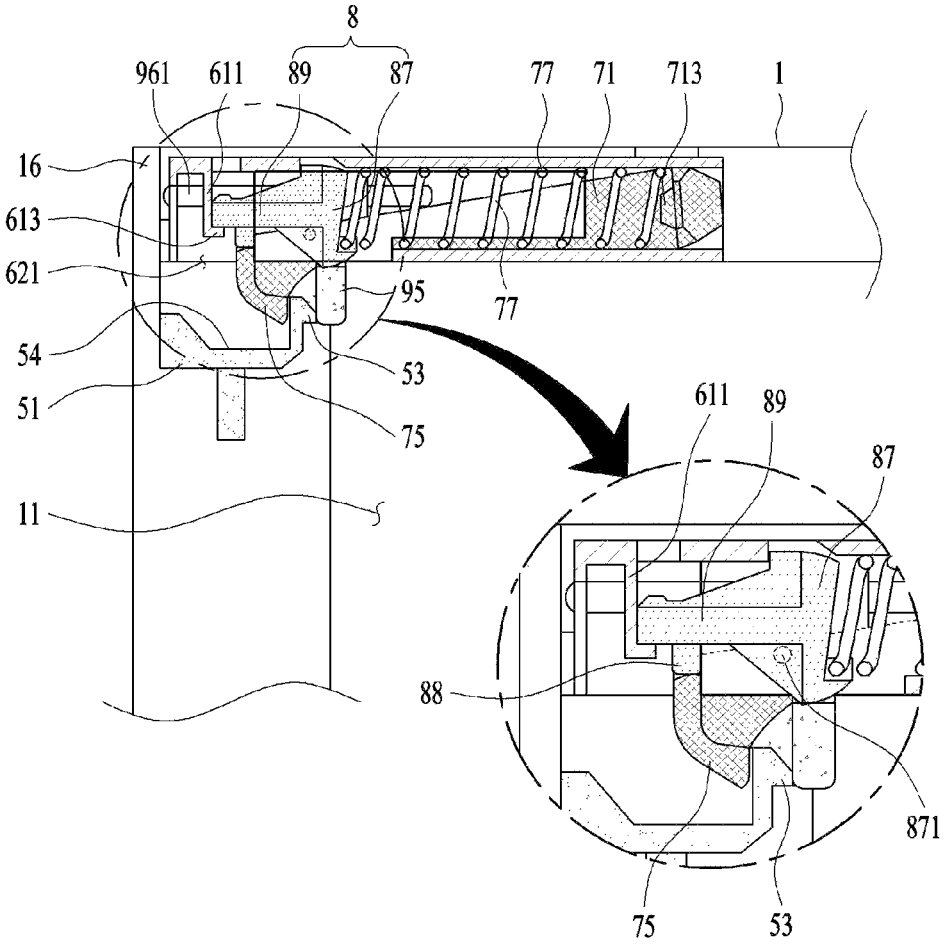

【Figure 7】
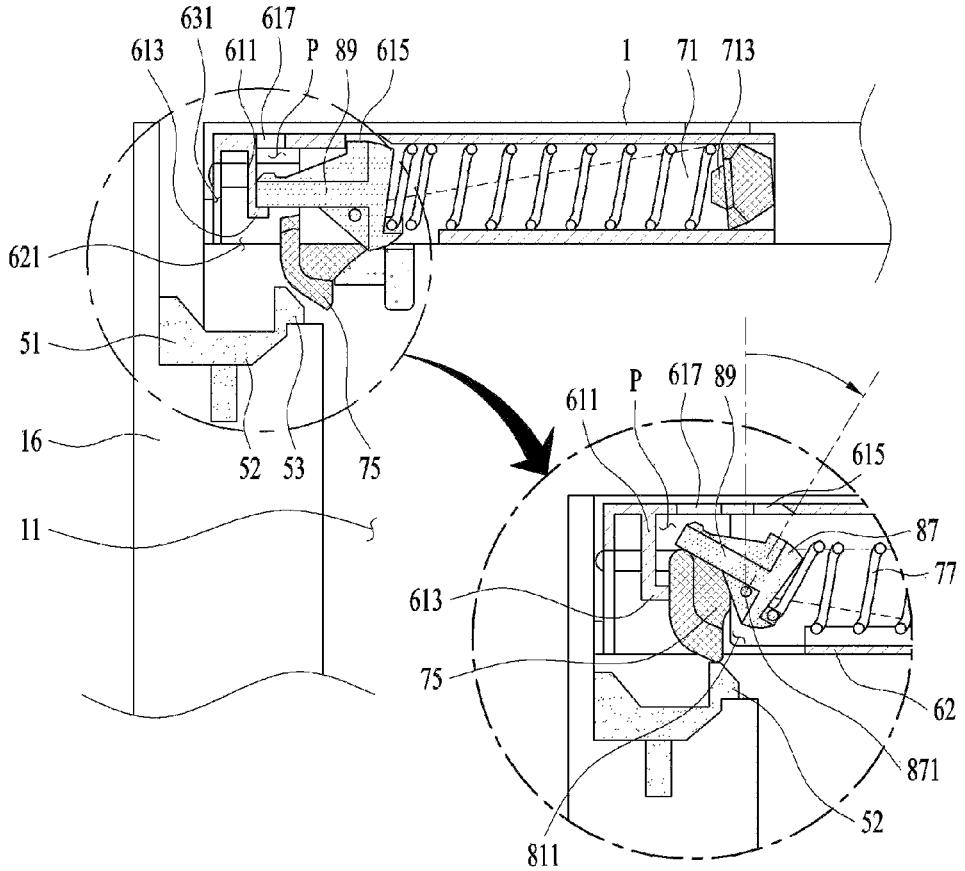

【Figure 8】
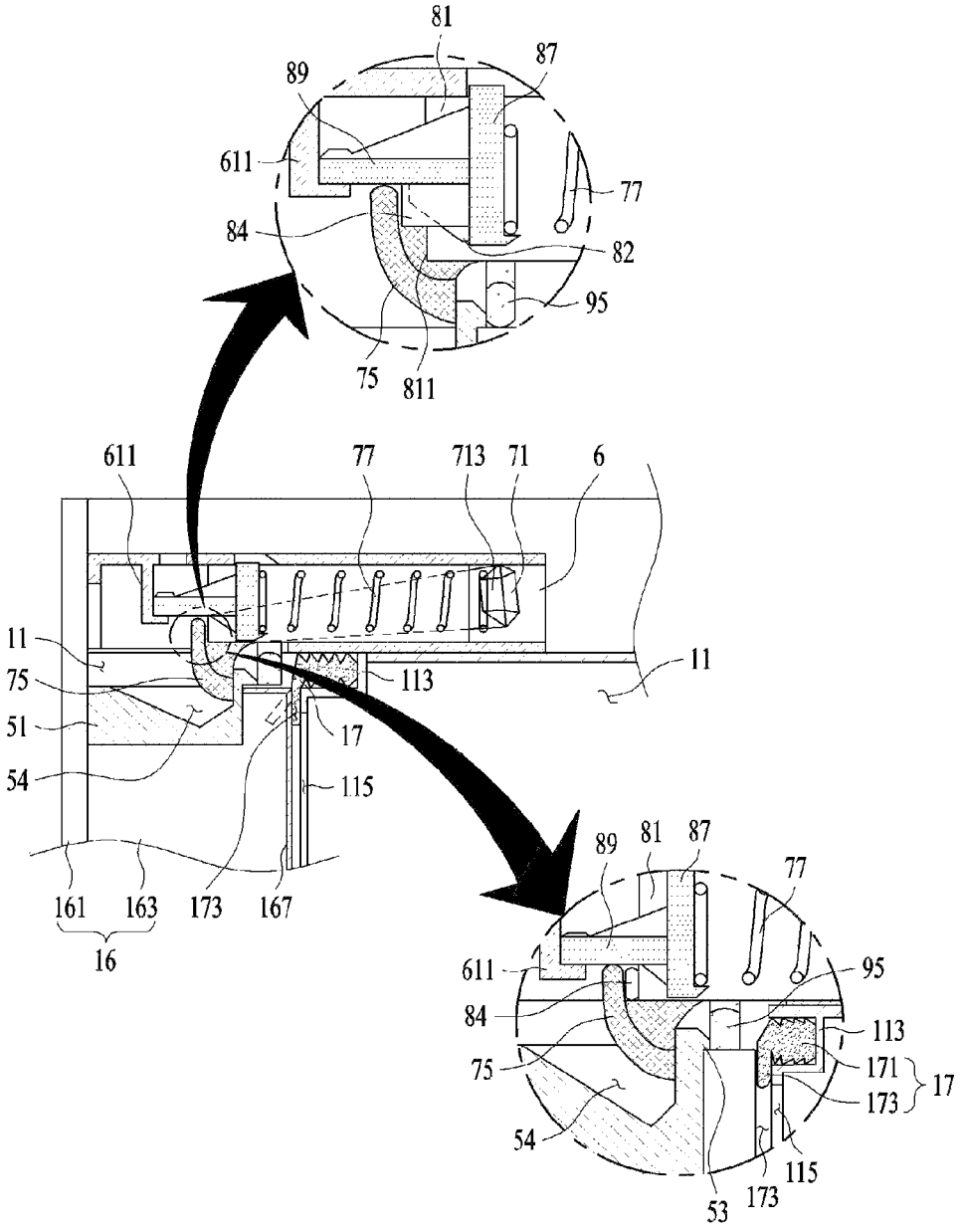

【Figure 9】
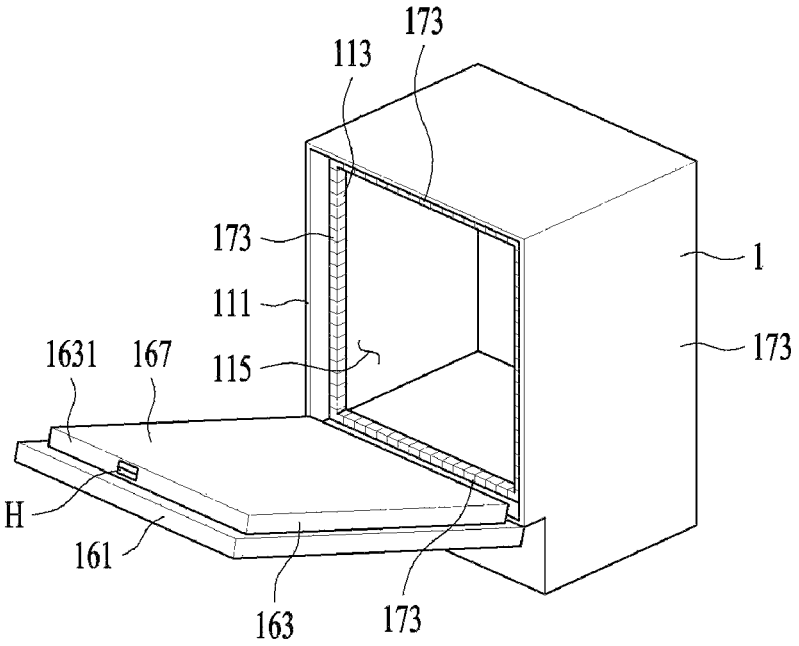
【Figure 10】
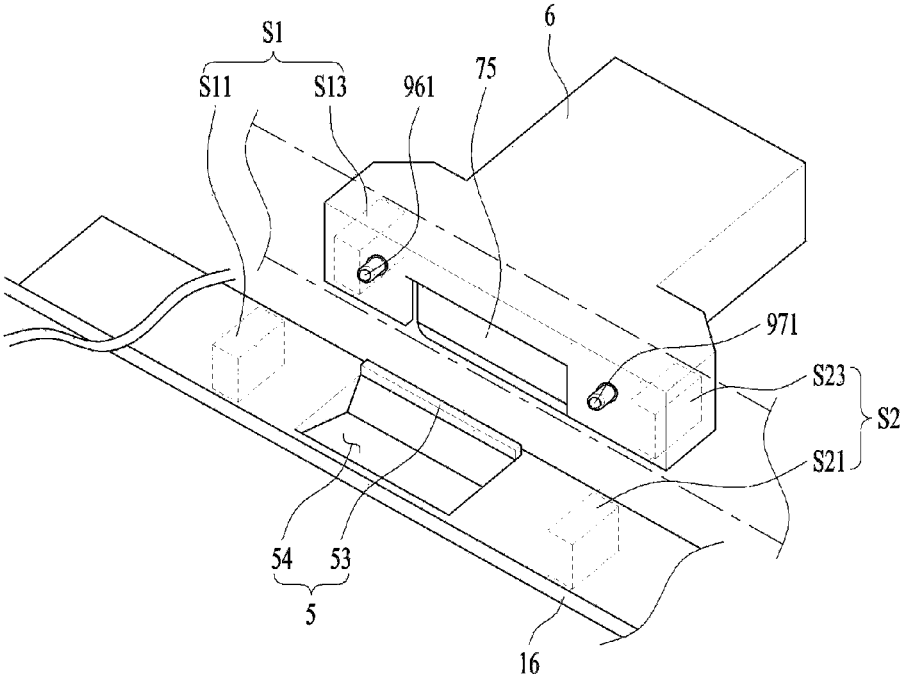

【Figure 11】
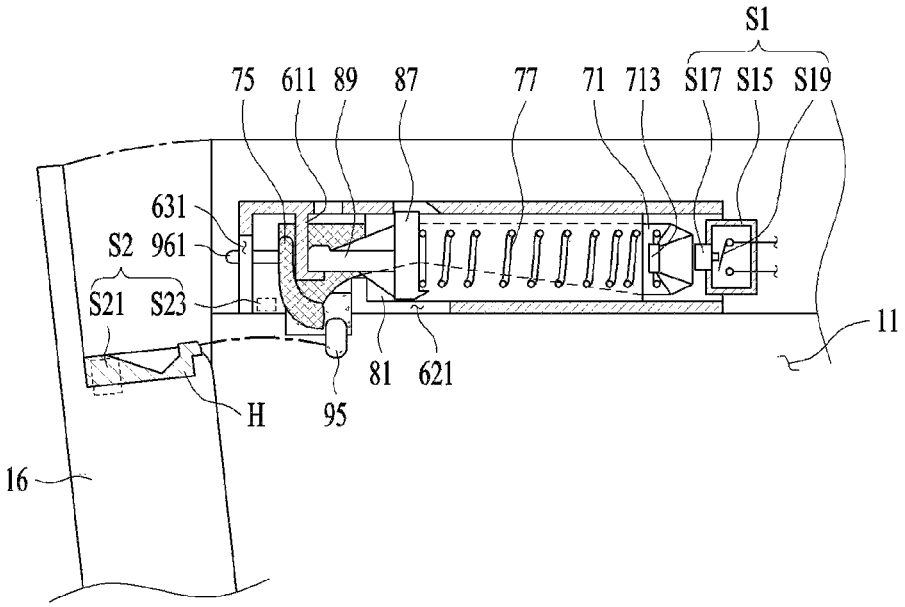

【Figure 12】
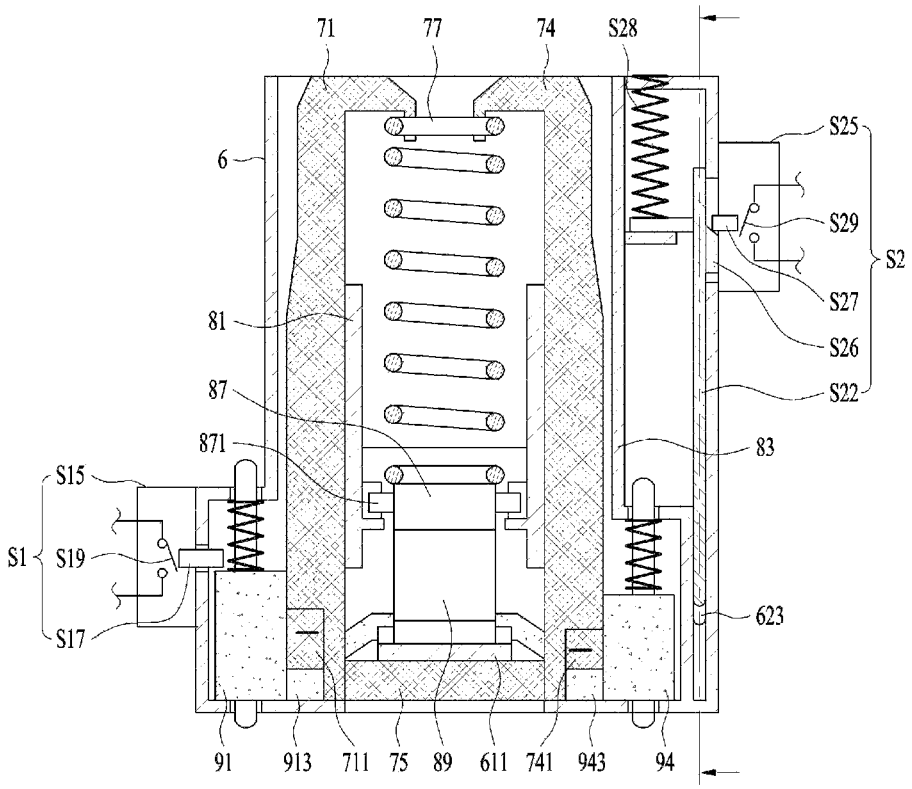

【Figure 13】
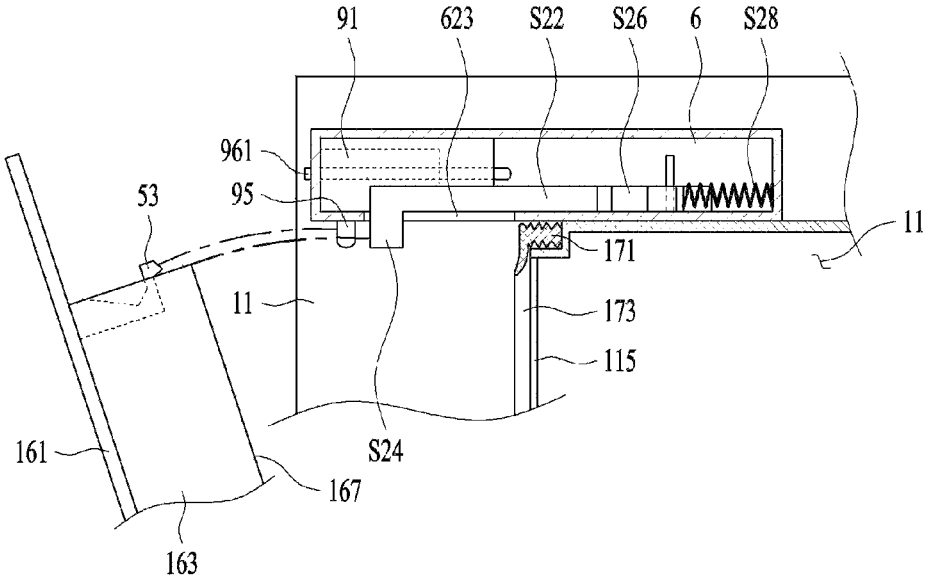

LOCK AND HOME APPLIANCE HAVING THE SAME

Pursuant to 35 U.S.C. § 119(a). This application claims the benefit of Korean Patent Application No. 10-2016-0001256, filed on Jan. 5, 2016, and Korean Patent Application No. 10-2016-0037156, filed on Mar. 28, 2016, which is hereby incorporated by reference as if fully set forth herein.

BACKGROUND OF THE INVENTION

Field of the Invention

The present invention relates to a lock and a home appliance having the same.

Discussion of the Related Art

In general, conventional apparatuses having doors, including home appliances, each include a cabinet, a storage space defined in the cabinet for receiving objects to be stored, and a door for opening and closing an introduction port communicating with the storage space.

The door is separably fixed to the cabinet via a lock. In general, a conventional lock includes a holder provided at the door and a coupling unit provided at the cabinet, the holder being separably coupled to the coupling unit.

The conventional lock having the above structure is designed such that force necessary to fix the door to the cabinet (i.e. force necessary to couple the holder to the coupling unit) and force necessary to separate the door from the cabinet (i.e. force necessary to separate the holder from the coupling unit) are the same.

In addition, in a home appliance (e.g. a dishwasher, a washer, or a dryer) in which the pressure in the storage space may be increased during operation thereof, the lock must be designed to provide sufficient fastening force to prevent the door from being separated from the cabinet even when the pressure in the space communicating with the introduction port is increased.

In the case in which the conventional lock provides sufficient fastening force to prevent the door from being separated from the cabinet during operation of the home appliance, it is possible to prevent the door from being opened, and thus prevent the introduction port from being opened, during the operation of the home appliance. When the holder is coupled to the coupling unit to close the introduction port, however, a user must apply excessive force to the door.

SUMMARY OF THE INVENTION

Accordingly, the present invention is directed to a lock and a home appliance having the same that substantially obviate one or more problems due to limitations and disadvantages of the related art.

An object of the present invention is to provide a lock configured such that force that a user is required to apply to a door in order to close an introduction port is smaller than force that the user is required to apply to the door in order to open the introduction port and a home appliance having the same.

Another object of the present invention is to provide a lock including a holder and a fastening unit provided respectively at a cabinet having therein an introduction port and a door for opening and closing the introduction port and a home appliance having the same.

Another object of the present invention is to provide a lock that is capable of preventing dislocation of a fastening unit, which is separably coupled to a holder, and a home appliance having the same.

Another object of the present invention is to provide a lock that is capable of performing a function of fixing a door to a cabinet even when a fastening unit is dislocated and a home appliance having the same.

Another object of the present invention is to provide a lock configured such that a holder and a fastening unit can be easily coupled to each other and such that the fastening unit is prevented from being separated from the holder when the holder and the fastening unit are coupled to each other and a home appliance having the same.

Another object of the present invention is to provide a lock configured such that a holder and a fastening unit can be coupled to each other when the fastening unit moves to a position where the fastening unit is coupled to the holder even when a door to an introduction port is not closed and a home appliance having the same.

Another object of the present invention is to provide a lock that is capable of generating a sound signal informing a user that the door to the introduction port is closed when the door to the introduction port is closed and a home appliance having the same.

Another object of the present invention is to provide a lock that is capable of preventing an excessive increase in the magnitude of a sound signal generated when a door to an introduction port is closed and a home appliance having the same.

Another object of the present invention is to provide a lock including a sensing unit for determining whether a door is closed and a home appliance having the same.

A further object of the present invention is to provide a lock including a sensing unit for determining whether a fastening unit is coupled to a holder and whether a door to an introduction port is closed and a home appliance having the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lock for separably fixing a door to a cabinet having an introduction port therein includes a holder provided at one selected from between the cabinet and the door, a housing provided at the other selected from between the cabinet and the door, a stopper provided at the housing, an actuation unit configured to reciprocate in the housing, the actuation unit being moved away from the introduction port by the holder when the door to the introduction port is closed, a fastening unit supported by the stopper, the fastening unit being separated from the stopper and coupled to the holder when the actuation unit is moved away from the introduction port, a first elastic member for providing force necessary to move the fastening unit away from the introduction port, and a second elastic member for providing force necessary to move the actuation unit toward the introduction port.

The fastening unit may include a fastening body separably provided at the stopper, the fastening body being coupled to the holder when separated from the stopper, and a first body and a second body extending from opposite ends of the fastening body so as to be distant from the introduction port. The actuation unit may include a first slide and a second slide configured to reciprocate in the movement direction of the holder, the first slide and the second slide being spaced apart from each other so as to define a space for receiving the first body and the second body, and a transfer part for connecting the first slide and the second slide, the transfer part being configured to be moved away from the introduction port by the holder.

The lock may further include a support unit fixed in the housing. One end of the first elastic member may be supported by the support unit, and the other end of the first elastic member may be supported by at least one selected from between the first body and the second body.

The support unit may include a support body rotatably fixed to the housing, one end of the first elastic member being fixed to the support body, and an extension part extending from the support body toward the stopper, the extension part enabling the fastening body to be movable into a space defined between the stopper and the support body when the fastening body is moved in the direction in which the fastening body is coupled to the holder.

The lock may further include a shaft provided at the support body for defining a center of rotation of the support body, a first plate and a second plate provided in the housing so as to be spaced apart from each other for defining the movement path of the first elastic member, and shaft support parts provided at the first plate and the second plate for supporting the shaft.

The stopper may include a location part for supporting a free end of the extension part to prevent rotation of the support body.

The lock may further include a body push part provided on at least one selected from between the first slide and the second slide for pushing at least one selected from between the first body and the second body such that the fastening body is separated from the stopper when the transfer part is moved away from the introduction port The body push part may include at least one selected from between a first body push part provided at the first slide for pushing the first body such that the fastening body is separated from the first stopper when the transfer part is moved away from the introduction port and a second body push part provided at the second slide for pushing the second body such that the fastening body is separated from the first stopper when the transfer part is moved away from the introduction port.

The lock may further include at least one selected from between a first body incline provided at the first body, the first body incline being inclined upward away from the introduction port, the first body incline contacting the first body push part when the transfer part is moved away from the introduction port, and a second body incline provided at the second body, the second body incline being inclined upward away from the introduction port, the second body incline contacting the second body push part when the transfer part is moved away from the introduction port.

The lock may further include a first receiving part provided at the housing for defining the movement path of the first slide and a second receiving part provided at the housing for defining the movement path of the second slide.

The second elastic member may include at least one selected from between a first spring provided in the first receiving part for pushing the first slide toward the introduction port and a second spring provided in the second receiving part for pushing the second slide toward the introduction port.

The lock may further include a first bar extending through the first slide for guiding the movement of the first slide and a second bar extending through the second slide for guiding the movement of the second slide.

The second elastic member may include at least one selected from between a first spring, into which the first bar is inserted, for pushing the first slide toward the introduction port, and a second spring, into which the second bar is inserted, for pushing the second slide toward the introduction port.

The first elastic member may remain compressed in the state in which the fastening body is supported by the stopper, the second elastic member may remain compressed in the state in which the fastening body is separated from the stopper, and force necessary to compress the first elastic member may be set to be larger than force necessary to compress the second elastic member.

In another aspect of the present invention, a lock for separably fixing a door to a cabinet having an introduction port therein includes a holder provided at one selected from between the cabinet and the door, a housing provided at the other selected from between the cabinet and the door, a first stopper provided at the housing, an actuation unit configured to reciprocate in the housing, the actuation unit being moved away from the introduction port by the holder when the door to the introduction port is closed, a fastening unit supported by the first stopper, the fastening unit being separated from the first stopper and coupled to the holder when the actuation unit is moved away from the introduction port, a first elastic member for providing force necessary to move the fastening unit away from the introduction port, and a second elastic member for providing force necessary to move the actuation unit toward the introduction port.

The fastening unit may include a fastening body separably provided at the first stopper, the fastening body being coupled to the holder when separated from the first stopper, and a first body and a second body extending from opposite ends of the fastening body so as to be distant from the introduction port. The actuation unit may include a first slide and a second slide configured to reciprocate in the movement direction of the holder, the first slide and the second slide being spaced apart from each other so as to define a space for receiving the first body and the second body, a transfer part for connecting the first slide and the second slide, the transfer part being configured to be moved away from the introduction port by the holder, and a body push part provided on at least one selected from between the first slide and the second slide for contacting the first body and the second body depending on the position of the transfer part to separate the fastening body from the first stopper.

The first elastic member may remain compressed when the fastening body is supported by the first stopper and may move the fastening body away from the introduction port when the fastening body is separated from the first stopper, the second elastic member may be compressed by at least one selected from between the first slide and the second slide while the actuation unit moves to the position at which the fastening body is separated from the first stopper, and force necessary to compress the first elastic member may be set to be larger than force necessary to compress the second elastic member.

The lock may further include a second stopper provided at the housing for limiting the movement of the fastening body when the fastening body is separated from the first stopper.

The lock may further include a first plate and a second plate located in a space defined between the first body and the second body for providing a space for receiving the first elastic member. The second stopper may include at least one selected from between one surface of the first plate, which faces the first stopper, and one surface of the second plate, which faces the first stopper.

The lock may further include a support body rotatably fixed to the first plate and the second plate and an extension part extending from the support body toward the first stopper. One end of the first elastic member may be fixed to the support body, and the other end of the first elastic member may be fixed to at least one selected from between the first body and the second body. The second stopper may locate the fastening body, separated from the first stopper, below the extension part.

The lock may further include a damper (e.g. a first damper) provided at one selected from between the fastening body and the second stopper for absorbing impact generated when the fastening body collides with the second stopper The lock may further include a damper (e.g. a second damper) fixed to the support body for preventing the fastening body from colliding with the second stopper.

The first stopper may include a location part for supporting the free end of the extension part to prevent the free end of the extension part from being exposed to the outside of the first stopper (i.e. from rotating toward the lower surface of the housing).

The body push part may include at least one selected from between a first body push part provided at the first slide for pushing the first body such that the fastening body is separated from the first stopper when the transfer part is moved away from the introduction port and a second body push part provided at the second slide for pushing the second body such that the fastening body is separated from the first stopper when the transfer part is moved away from the introduction port.

The lock may further include at least one selected from between a first body incline provided at the first body, the first body incline being inclined upward away from the introduction port, the first body incline contacting the first body push part when the transfer part is moved away from the introduction port, and a second body incline provided at the second body, the second body incline being inclined upward away from the introduction port, the second body incline contacting the second body push part when the transfer part is moved away from the introduction port.

The lock may further include a first receiving part provided at the housing for defining the movement path of the first slide and a second receiving part provided at the housing for defining the movement path of the second slide.

The second elastic member may include at least one selected from between a first spring provided in the first receiving part for pushing the first slide toward the introduction port and a second spring provided in the second receiving part for pushing the second slide toward the introduction port.

The lock may further include a first bar extending through the first slide for guiding the movement of the first slide and a second bar extending through the second slide for guiding the movement of the second slide.

The second elastic member may include at least one selected from between a first spring, into which the first bar is inserted, for pushing the first slide toward the introduction port, and a second spring, into which the second bar is inserted, for pushing the second slide toward the introduction port.

The lock may further include a first magnet provided at one selected from between the door and the cabinet, a first signal generator provided at the other selected from between the door and the cabinet for sensing magnetic force of the first magnet and generating an electrical signal when the door to the introduction port is closed, a second magnet provided at one selected from between the door and the cabinet, the second magnet being spaced apart from the first magnet in the state in which the housing is located between the first magnet and the second magnet, and a second signal generator provided at the other selected from between the door and the cabinet for sensing magnetic force of the second magnet and generating an electrical signal when the door to the introduction port is closed.

The lock may further include a first sensing unit for determining whether the fastening body is separated from the first stopper and a second sensing unit for determining whether the door to the introduction port is closed.

The first sensing unit may include a first push part configured to contact at least one selected from between the first body and the second body when the fastening body is separated from the first stopper and a first switch for generating an electrical signal when the at least one selected from between the first body and the second body contacts the first push part.

The first sensing unit may include a first push part configured to contact at least one selected from between the first slide and the second slide when the actuation unit moves to the position at which the fastening body is separated from the first stopper and a first switch for generating an electrical signal when the at least one selected from between the first slide and the second slide contacts the first push part.

The second sensing unit may include a magnet provided at one selected from between the door and the cabinet and a signal generator provided at the other selected from between the door and the cabinet for sensing magnetic force of the magnet and generating an electrical signal when the door to the introduction port is closed.

The second sensing unit may include a sensing body configured to reciprocate in the housing, a protruding body configured to contact the door to move the sensing body away from the introduction port when the door is moved in a direction in which the introduction port is closed, a body support part for providing force necessary to move the protruding body toward the introduction port, a second push part configured to contact the sensing body when the door to the introduction port is closed, and a second switch for generating an electrical signal when the sensing body contacts the second push part.

In a further aspect of the present invention, a home appliance includes a cabinet having an introduction port therein, a tub provided in the cabinet for defining a space for receiving objects to be stored, a communication hole, through which the tub communicates with the introduction port, a door including a first door body for opening and closing the introduction port, a second door body protruding from the first door body toward the tub, and a closing surface provided at the second door body for closing the communication hole when the first door body closes the introduction port, a sealing part provided along the edge of the communication hole, the sealing part being compressed between the closing surface and the edge of the communication hole when the first door body closes the introduction port, a holder provided at the door, a housing provided at the cabinet, a first stopper provided at the housing, the first stopper being located between the introduction port and the communication hole, a fastening unit separably supported by the first stopper, the fastening unit being coupled to the holder when separated from the first stopper, an actuation unit configured to reciprocate in the housing, the actuation unit being moved toward the communication hole in the state of contacting the holder when the first door body is moved in the direction in which the introduction port is closed, the actuation unit being configured to separate the fastening unit from the first stopper while the actuation unit is moved toward the communication hole, a first elastic member for providing force necessary to move the fastening unit away from the introduction port, and a second elastic member for providing force necessary to move the actuation unit toward the introduction port.

The fastening unit may include a fastening body separably coupled to the first stopper, the fastening body being coupled to the holder when separated from the first stopper, and a first body and a second body extending from opposite ends of the fastening body so as to be distant from the introduction port. The actuation unit may include a first slide and a second slide configured to reciprocate in the housing, the first slide and the second slide being spaced apart from each other so as to define a space for receiving the first body and the second body, a transfer part for connecting the first slide and the second slide, the transfer part being configured to be moved toward the communication hole by the holder, and a body push part provided on at least one selected from between the first slide and the second slide for contacting the first body and the second body depending on the position of the transfer part to separate the fastening body from the first stopper.

The range in which the transfer part is reciprocated may be set such that the transfer part cannot contact the sealing part when the closing surface closes the communication hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a view showing an example of a home appliance having a lock according to the present invention;

FIGS. 2 to 4 are views showing an example of the lock according to the present invention;

FIGS. 5 and 6 are views showing the operation of the lock according to the present invention;

FIG. 7 is a view showing a process in which a holder and a fastening unit are coupled to each other in the state in which the lock is abnormal;

FIG. 8 is a view showing an example of a lock having a damper and an example of a home appliance having the lock;

FIG. 9 is a view showing an example of a gasket provided in the present invention; and FIGS. 10 to 13 are views showing a detection unit provided in the present invention.

DETAILED DESCRIPTION OF THE INVENTION

Reference will now be made in detail to the preferred embodiments of the present invention, examples of which are illustrated in the accompanying drawings. The construction and control method of an apparatus, a description of which will follow, are provided to explain embodiments of the present invention, rather than to define the scope of the present invention. Wherever possible, the same reference numbers will be used throughout the drawings to refer to the same or like parts.

The present invention relates to a lock for separably fixing a door to a cabinet having an introduction port. FIG. 1 is a view showing an example of a dishwasher having a lock H and C according to the present invention.

The lock H and C may be provided in various home appliances other than the dishwasher. Hereinafter, a dishwasher 100 having the lock H and C will be described for the convenience of description.

As shown in FIG. 1, the dishwasher 100 may include a cabinet 1, a tub 11 provided in the cabinet for defining a washing space, spray arms 21 and 23 for spraying water to objects to be washed, and a pump 4 for supplying water to the spray arms.

A rack for receiving objects to be washed may be provided in the tub 11. The rack may include an upper rack 191 provided in the upper region of the tub and a lower rack 193 disposed below the upper rack.

The tub 11 communicates with the outside of the cabinet through an introduction port 111 (see FIG. 5). The introduction port 111 is opened and closed by a door 16. Consequently, a user may open the door 16 to withdraw the racks 191 and 193 from the tub 11 through the introduction port 111.

In the case in which the rack includes an upper rack 191 and a lower rack 193, the spray arms may include an upper arm 21 for spraying water to the upper rack 191 and a lower arm 23 for spraying water to the lower rack 193.

The water sprayed to the objects from the spray arms 21 and 23 (i.e. the water remaining in the tub) may be collected in a sump 13.

The sump 13 is provided under the tub 11 for storing water. The sump 13 may be partitioned from the tub 11 by a sump cover 15. In this case, the sump cover 15 may be provided with a collection hole 151, through which water from the tub 11 is collected in the sump 13.

Meanwhile, the sump 13 may be connected to a water supply source (not shown) via a water supply channel 135. The water supply channel 135 may be configured to be opened and closed by a valve 136.

The water stored in the sump 13 is discharged out of the dishwasher via a drainage channel 137 and a drainage pump 139.

The water stored in the sump 13 is supplied to the spray arms 21 and 23 via a pump 4 and a supply channel 3. The supply channel 3 may include a connection channel 31 connected to the pump 4, a first supply channel 33 for connecting the connection channel and the upper arm 21, and a second supply channel 35 for connecting the connection channel and the lower arm 23.

The upper arm 21 may be rotatably coupled to the first supply channel 33, and the lower arm 23 may be rotatably coupled to the second supply channel 35.

The first supply channel 33 and the second supply channel 35 diverge from the connection channel 31. A switch valve 37 for controlling the opening and closing of the supply channels may be provided at the divergence point where the first supply channel 33 and the second supply channel 35 diverge from the connection channel 31.

The pump 4 may include a pump body 41 fixed in the cabinet 1, a partition wall 42 for partitioning the interior of the pump body 41 into a first pump chamber 421 and a second pump chamber 422, a partition wall through hole 43 provided in the partition wall 42 for allowing the first pump chamber 421 and the second pump chamber 422 to communicate with each other, and an impeller 45 provided in the second pump chamber.

The first pump chamber 421 is connected to the sump 13 via a pump inlet 423 formed through the pump body 41, and the second pump chamber 422 is connected to the connection channel 31 via a pump outlet 424 formed through the pump body 41.

The impeller 45 is rotated by a motor 46, which is fixed to the upper surface of the pump body 41. A rotary shaft of the motor is connected to the impeller 45 through the upper surface of the pump body.

Meanwhile, the first pump chamber 421 is provided at the bottom surface thereof with a heating unit 47. In the case in which the lower surface of the pump body 41 is formed in an open cylindrical shape, the heating unit 47 may define the bottom surface of the first pump chamber 421.

In this case, the heating unit 47 may include a heating plate 471 defining the bottom surface of the first pump chamber 421 and a heater 473 fixed to the heating plate in the state of being located outside the first pump chamber 421. The heating plate may be made of a metal exhibiting high thermal conductivity.

Since the heating unit 47 defines the bottom surface of the first pump chamber 421, the pump 4 may simultaneously perform a function of supplying water to the spray arms 21 and 23 and a function of heating water.

In addition, steam may be supplied into the tub 11 from the heating unit 47, which is provided in the pump 4. To this end, the dishwasher 100 may further include a steam supply unit 25.

The steam supply unit 25 may include a nozzle 251 for spraying steam into the tub 11, a steam supply pipe 253 for connecting the nozzle 251 and the first pump chamber 421, and a steam valve 255 for opening and closing the steam supply pipe.

FIG. 1 shows an example in which the nozzle 251 is provided in the door 16. In this case, the nozzle 251 may be fixed to the lower part of one surface of the door, which defines a wash space.

Meanwhile, the door 16 may be separably fixed to the cabinet 1 through the lock H and C. The lock may include a holder H provided at one selected from between the door 16 and the cabinet 1 and a coupling unit C provided at the other selected from between the door and the cabinet such that the holder H is separably coupled to the coupling unit C.

In a conventional lock, force necessary to fix the door 16 to the cabinet 1 (i.e. force necessary to couple the holder to the coupling unit) and force necessary to separate the door 16 from the cabinet 1 (i.e. force necessary to separate the holder from the coupling unit) are the same.

Meanwhile, in a home appliance (e.g. a dishwasher, a washer, or a dryer) in which the pressure in a space communicating with the introduction port may be increased, the lock must be designed to provide sufficient fastening force to prevent the door from being separated from the cabinet even when the pressure in the space communicating with the introduction port is increased.

In the case in which the conventional lock provides sufficient fastening force to prevent the door from being separated from the cabinet, it is possible to prevent the door from being opened, and thus prevent the introduction port from being opened, during the operation of the home appliance. When the holder is coupled to the coupling unit to close the introduction port, however, the user must apply excessive force to the door.

The lock H and C is characterized in that force necessary to couple the holder H to the coupling unit C is smaller than force necessary to separate the holder H from the coupling unit C.

That is, the lock H and C is characterized in that force applied to the door 16 in order to close the introduction port 111 is smaller than force applied to the door 16 in order to open the introduction port 111.

As previously described, the holder H may be provided at one selected from between the door and the cabinet, and the coupling unit C may be provided at the other selected from between the door and the cabinet. In the following description, the holder H is provided at the door 16, and the coupling unit C is provided at the cabinet 1, for the convenience of description.

As shown in FIG. 2, the holder H may include a holder body 51 fixed to the door 16 and a protrusion 53 provided on the holder body 51 so as to be fastened to the coupling unit C. The holder body 51 may be further provided with a receiving recess 54 for receiving a fastening body 75 of the coupling unit, a description of which will follow.

The shape of the holder H may be changed depending on the shape of the coupling unit C. In addition, unlike what is shown in FIG. 2, the holder H may include only a receiving recess 54 formed by concavely bending the upper surface of the door 16.

In any case, the coupling unit C may include a housing 6 fixed to the cabinet 1, a stopper (e.g. a first stopper) 611 provided at the housing 6, an actuation unit 9 (see FIG. 3) configured to be reciprocated in the housing by the holder H, a fastening unit 7 (see FIG. 3) configured to remain supported by the stopper 611 and to be separated from the stopper 611 and then be coupled to the holder H when the actuation unit 9 is moved away from the introduction port 111 by the holder H, a first elastic member 77 for providing force necessary to move the fastening unit 7 away from the introduction port 111, and a second elastic member 981 and 983 for providing force necessary to move the actuation unit 9 toward the introduction port 111.

The shape of the housing 6 is not particularly restricted as long as the fastening unit 7 and the actuation unit 9 are movable as described above. That is, the housing 6 may be defined in the cabinet 1 so as to guide the movement of the fastening unit 7 and the actuation unit 9. Alternatively, the housing 6 may be a separate element, which is coupled to the cabinet 1.

FIGS. 2 and 4 show an example in which the housing 6 includes a front surface 63 facing the introduction port 111, an upper surface 61 located at the upper end of the front surface 63, and a lower surface 62 located at the lower end of the front surface 63.

In this case, the lower surface 62 may be provided with a lower surface through hole 621, through which the protrusion 53 of the holder contacts the fastening unit 7, and the stopper 611 may protrude from the upper surface 61 of the housing toward the lower surface through hole 621.

However, the lower surface through hole 621 may not be provided depending on the shape of the housing 6. That is, in the structure in which the entirety of the holder H is inserted into the housing 6 so as to be coupled to the fastening unit 7, the lower surface through hole 621 is not necessary. In this case, the housing may be provided in the front surface 63 thereof with a hole, through which the holder is inserted into the housing 6.

As shown in FIG. 3, the fastening unit 7 may include a fastening body 75 separably provided at the first stopper 611 and a first body 71 and a second body 74 extending from opposite ends of the fastening body 75 so as to be distant from the introduction port 111.

The shapes of the first body 71 and the second body 74 are not particularly restricted as long as the first body 71 and the second body 74 can reciprocate in the housing 6 in the direction parallel to the movement path of the holder H. The figure shows an example in which each of the first body 71 and the second body 74 is formed in the shape of a bar extending from the fastening body 75 toward the rear of the housing.

When the first body 71 or the second body 74 is pushed by the actuation unit 9, the fastening body 75 may be separated from the first stopper 611. The fastening body 75, separated from the first stopper 611, may be inserted into the receiving recess 54 of the holder to support the protrusion 53.

The actuation unit 9 is characterized by reciprocating in the housing 6 in the direction parallel to the movement path of the holder H. The actuation unit 9 includes a first slide 91 and a second slide 94 configured to reciprocate in the housing and a transfer part 95 for connecting the first slide 91 and the second slide 94, the transfer part being configured to be movable away from the introduction port 111 by the holder H.

The first slide 91 and the second slide 94 are spaced apart from each other so as to define a space for receiving the first body 71 and the second body 74, but are connected to each other via the transfer part 95.

The shapes of the first slide 91 and the second slide 94 are not particularly restricted as long as the first slide 91 and the second slide 94 can reciprocate in the housing 6. FIG. 3 shows an example in which each of the slides 91 and 94 is formed in the shape of a bar parallel to a corresponding one of the first and second bodies 71 and 74.

The shape of the transfer part 95 is not particularly restricted as long as the transfer part 95 can connect the slides 91 and 94 and can be moved away from the introduction port 111 by the protrusion 53 of the holder when the door 16 to the introduction port 111 is closed. In the case in which the lower surface through hole 621 is provided in the lower surface 62 of the housing, however, the transfer part 95 may be exposed to the outside of the lower surface through hole 621.

Furthermore, the actuation unit 9 may further include a body push part for pushing at least one of the first and second bodies 71 and 74 such that the fastening body 75 moves so as to be separated from the first stopper 611 when the transfer part 95 moves away from the introduction port 111.

FIG. 3 shows an example in which the body push part includes a first body push part 913 provided at the first slide 91 for pushing the first body 71 and a second body push part 943 provided at the second slide 94 for pushing the second body 74.

The first body push part 913 may protrude from the first slide 91 toward the second slide 94, and the second body push part 943 may protrude from the second slide 94 toward the first slide 91.

In this case, the first body 71 may be provided with a first body incline 711 contacting the first body push part 913, and the second body 74 may be provided with a second body incline 741 contacting the second body push part 943.

The first body incline 711 may contact the first body push part 913 only when the first slide 91 moves a predetermined distance away from the introduction port 111. That is, the first body incline 711 may be provided at the region of the first body 71 where the fastening body 75 is located so as to be inclined upward away from the introduction port 111.

Similarly, the second body incline 741 may be provided at the region of the second body 74 where the fastening body 75 is located so as to be inclined upward away from the introduction port 111.

The actuation unit 9 is constituted by the first slide 91 and the second slide 94, located outside the space defined between the first body 71 and the second body 74, in consideration of the possibility of the fastening unit 7 becoming dislocated in the housing 6.

As previously described, the first body 71 and the second body 74 reciprocate in the housing 6, and the fastening body 75 is coupled to the first body 71 and the second body 74. When the first body 71 and the second body 74 are dislocated, therefore, the fastening body 75 may not be coupled to the holder H.

In the present invention, however, the first body 71 and the second body 74 are located in the space defined between the first slide 91 and the second slide 94, thereby minimizing the dislocation of the first body and the second body in the housing.

Furthermore, even when the first body 71 and the second body 74 are dislocated, the fastening body 75 may, when desired, be separated from the first stopper 611 by the first slide 91 and the second slide 94, which are provided outside the first body 71 and the second body 74, respectively.

It is assumed that the fastening unit 7 is dislocated in the state in which the actuation unit 9 includes only a single slide.

In this case, when the transfer unit 95 is moved away from the introduction port 111 by the holder H, the actuation unit 9, which includes only a single slide, may push the first body 71 or the second body 74 earlier than a predetermined time, or may push neither the first body 71 nor the second body 74.

In the case in which the actuation unit 9 includes a first slide and a second slide spaced apart from each other so as to provide a space for receiving the first body 71 and the second body 74, however, the fastening body 75 may be uniformly separated from the first stopper 611. The reason for this is that, since the first slide 91 and the second slide 92 are means for minimizing the range in which the first body 71 and the second body 74 are dislocated, variation in the time at which one of the body push parts 913 and 943 contacts one of the bodies 71 and 74 may be minimized Meanwhile, as shown in FIG. 2, the actuation unit 9 may include a first guide 96 for guiding the movement of the first slide 91 and a second guide 97 for guiding the movement of the second slide 94.

The first guide 96 may include at least one selected from between a first receiving part 963 provided in the housing 6 for defining the movement path of the first slide 91 and a first bar 961 extending through the first slide 91 for defining the movement path of the first slide 91.

Similarly, the second guide 97 may include at least one selected from between a second receiving part 973 provided in the housing 6 for defining the movement path of the second slide 94 and a second bar 971 extending through the second slide 94 for defining the movement path of the second slide 94.

FIG. 2 shows an example in which the first guide 96 includes a first bar 961 and a first receiving part 963 and in which the second guide 97 includes a second bar 971 and a second receiving part 973. At least one of the first and second bars 961 and 971 may be omitted.

The second elastic member may include at least one selected from between a first spring 981 provided in the first receiving part 963 for pushing the first slide 91 toward the introduction port 111 and a second spring 983 provided in the second receiving part 973 for pushing the second slide 94 toward the introduction port 111.

In the case in which the first bar 961 and the second bar 971 are provided, the first bar 961 may be fixed in the first receiving part 963 in the state of being inserted into the first spring 981, and the second bar 971 may be fixed in the second receiving part 973 in the state of being inserted into the second spring 983. As a result, the respective springs 981 and 983 are prevented from being dislocated or damaged when the first slide 91 and the second slide 94 reciprocate in the respective receiving parts 963 and 973.

In the actuation unit 9 having the above structure, the protrusion 53 of the holder H contacts the transfer part 95 when the door 16 to the introduction port 111 is closed, with the result that the respective slides 91 and 94 move away from the introduction port 111 (i.e. to the rear of the housing).

At this time, the first spring 981 and the second spring 983 are compressed in the respective receiving parts 963 and 973. When external force applied to the transfer part 95 from the holder H is removed (i.e. when the door is moved in the direction in which the introduction port is opened), therefore, the respective slides 91 and 94 may be moved toward the introduction port 111 by restoring force of the first spring 981 and the second spring 983.

One end of the first elastic member 77, which provides force necessary to move the fastening unit 7 away from the introduction port 111 (i.e. to the rear of the housing), may be fixed to the housing 6, and the other end of the first elastic member 77 may be fixed to at least one selected from between a free end of the first body 71 and a free end of the second body 74.

To this end, the housing 6 may be provided with a support unit 9 for supporting one end of the first elastic member 77, and a first coupling recess 713 and a second coupling recess 743, in which the other end of the first elastic member 77 is fixed, may be provided in the free end of the first body 71 and the free end of the second body 74, respectively.

As shown in FIG. 4, the first elastic member 77 may be a spring configured to remain compressed between the support unit 8 and the coupling recesses 713 and 743 in the state in which the fastening body 75 is supported by the stopper 611.

One end of the first elastic member 77 is fixed to the support unit 8, which is fixed to the housing 6, and the other end of the first elastic member 77 is fixed to the free ends of the bodies 71 and 74 in the compressed state. In the state in which the fastening body 75 is supported by the first stopper 611, therefore, the first elastic member 77 may provide force necessary to move the free end of the first body 71 and the free end of the second body 74 away from the support unit 8. Consequently, the first elastic member 77 prevents the fastening body 75 from being separated from the first stopper 611 in the state in which the fastening body 75 is supported by the first stopper 611.

When the fastening body 75 is separated from the first stopper 611, however, the length of the first elastic member 77 is increased away from the support unit 8 due to restoring force thereof. Consequently, the first elastic member 77 may move the fastening body 75 away from the introduction port 111 when the fastening body 75 is separated from the first stopper 611.

The lock H and C having the above structure is operated as shown in FIGS. 5 and 6.

FIG. 5 shows the state in which the introduction port 111 is open as the result of opening the door 16. In this case, the fastening body 75 remains supported by the first stopper 611 due to force applied by the first elastic member 77.

Meanwhile, when the user moves the door 16 so as to close the introduction port 111, the protrusion 53 of the holder H, which is provided at the door, is moved toward the coupling unit C, which is provided at the cabinet 1.

While the door 16 is turned to close the introduction port 111, as shown in FIG. 6, the protrusion 53 of the holder pushes the transfer part 95, which is provided at the coupling unit, away from the introduction port 111.

When the transfer part 95 is moved away from the introduction port 111 by the protrusion 53, the first slide 91 and the second slide 94, which are connected to each other via the transfer part 95, move away from the introduction port 111 while pushing the second elastic member 981 and 983.

When the first slide and the second slide move away from the introduction port 111, the first body 71 and the second body 74, which are provided at the fastening u nit 7, are pushed toward the lower surface 62 of the housing by the body push parts 913 and 943, which are provided at the respective slides.

When the first body 71 and the second body 74 are pushed toward the lower surface of the housing, the fastening body 75, which is supported by the first stopper 611, is separated from the first stopper 611 and moves toward the lower surface through hole 621. At this time, the fastening body 75 is inserted into the receiving recess 54 of the holder.

Meanwhile, when the fastening body 75 is separated from the first stopper 611, the free end of the first body 71 and the free end of the second body 74 are moved away from the introduction port 111 by restoring force of the first elastic member 77.

When the fastening body 75 is separated from the first stopper 611, the fastening body 75 is inserted into the receiving recess 54 of the holder, and the restoring force of the first elastic member 77 is set to be greater than force necessary for compressing the second elastic member. When the fastening body 75 is separated from the first stopper 611, therefore, the first elastic member 77 moves the holder H toward the introduction port 111. In the present invention, therefore, it is possible to minimize force that the user is required to apply to the door 16 to close the introduction port 111.

In addition, when the fastening body 75 is inserted into the receiving recess 54 of the holder, the protrusion 53 of the holder is located in the space between the fastening body 75 and the transfer part 95. When the door 16 to the introduction port 111 is closed, therefore, the position of the protrusion 53 may be fixed. Consequently, it is possible for the lock H and C according to the present invention to minimize the movement of the door 16 such that the introduction port 111 is opened when the door 16 to the introduction port 111 is closed (i.e. it is possible to prevent a gap from being formed between the door and the introduction port).

Meanwhile, when the user wishes to open the door 16 and thus open the introduction port 111, the user pulls the door 16 away from the introduction port 111. In this case, the fastening body 75 is moved toward the introduction port 111 by the protrusion 53 of the holder.

When the fastening body 75 is moved toward the introduction port 111, the first elastic member 77 is compressed toward the support unit 8 by the free end of the first body 71 and the free end of the second body 74, which are fixed to the fastening body 75, and the first slide 91 and the second slide 94 are moved toward the introduction port 111 by restoring force of the second elastic member 981 and 983.

Meanwhile, when the first elastic member 77 is compressed toward the support unit 8 as the result of the fastening body 75 being moved toward the introduction port 111, the fastening body 75 is withdrawn from the receiving recess 54 of the holder and is then coupled to the first stopper 611. Consequently, the user may apply force necessary to compress the first elastic member 77 to the door in order to separate the holder H from the coupling unit C.

In the lock having the above structure, a large amount of force is required to compress the second elastic member 981 and 983 when the introduction port 111 is closed, and a large amount of force is required to compress the first elastic member 77 when the introduction port 111 is opened.

As previously described, force necessary to compress the first elastic member 77 is set to be greater than force necessary to compress the second elastic member 981 and 983. In the present invention, therefore, it is possible to provide a lock configured such that force to be applied to the door so as to open the introduction port 111 is greater than force to be applied to the door so as to close the introduction port.

Meanwhile, in order to prevent the fastening body 75 from interfering with the front surface 63 of the housing when the fastening body 75 moves toward the introduction port 111 such that the holder H is separated from the coupling unit C (i.e. such that the door is moved so as to open the introduction port), a through hole 631, through which the fastening body 75 is withdrawn out of the housing 6, may be further provided in the front surface 63 of the housing.

In the lock having the above structure, the fastening body 75 may be separated from the first stopper 611 when external force is applied to the housing 6 via the cabinet 1 in the state in which the introduction port 111 is open as the result of opening the door 16.

When the introduction port 111 is opened by the door 16, the state in which the fastening body 75 is supported by the first stopper 611, as shown in FIG. 5, may be defined as a normal state, and the state in which the fastening body 75 is separated from the first stopper 611, as shown in FIG. 7, may be defined as an abnormal state.

In the lock H and C according to the present invention, a means capable of coupling the holder and the fastening unit 7 even when the fastening unit is in an abnormal state is needed. In the case in which the support unit 8 is configured to have the structure shown in FIG. 2, the support unit 8 may be a means for coupling the holder and the fastening unit 7 even when the fastening unit is in an abnormal state.

As shown in FIG. 2, the support unit 8 may include a support body 87 rotatably fixed to the housing, one end of the first elastic member 77 being fixed to the support body 87, and an extension part 89 extending from the support body 87 toward the first stopper 611.

As shown in FIG. 4, a first plate 81 and a second plate 83, which are spaced apart from each other to provide a space for receiving the first elastic member 77, may be provided in the housing 6. In this case, the support body 87 may be located between the first plate 81 and the second plate 83.

The first plate 81 and the second plate 83 may define the movement path of the first elastic member 77, thereby preventing the first elastic member 77 from being dislocated or damaged.

In addition, the first plate 81 and the second plate 83 may also serve as a stopper (e.g. a second stopper) 811 for preventing the fastening body 75, separated from the first stopper 611, from moving to the rear of the housing 6. In this case, the second stopper 811 may support the fastening body 75 such that the fastening body 75, separated from the first stopper 611, is located below the extension part 89.

The second stopper may include at least one selected from between one surface 811 of the first plate that faces the first stopper 611 and one surface 831 of the second plate that faces the first stopper 611. FIG. 4 shows an example in which the second stopper includes the front surface 811 of the first plate and the front surface 831 of the second plate.

The support body 87 may be provided with a shaft 871 protruding toward the respective plates 81 and 83 for defining a rotary shaft of the extension part 89. The first plate 81 and the second plate 83 may be provided with shaft support parts 85, in which the shaft is received.

Of course, the shaft support parts 85 may be provided at opposite surfaces of the support body 87 facing the respective plates, and the shaft 971 may protrude from the respective plates 81 and 83 toward the shaft support parts.

As shown in FIG. 7, the extension part 89 is a means for moving the fastening body 75 into a space P defined between the first stopper 611 and the support body 87 when the fastening body 75 is separated from the first stopper 611.

When the fastening body 75 is separated from the first stopper 611, the fastening body 75 is supported by the second stopper 811 and 831, with the result that the fastening body 75 is located below the extension part 89. When the user pushes the door 16 to close the introduction port 111 in this state, the protrusion 53 of the holder pushes the fastening body 75 toward the extension part 89.

The portion of the space defined by the fastening body 75 that the protrusion 53 of the holder contacts may be inclined such that the fastening body 75 is more easily pushed toward the extension part 89.

When the fastening body 75 is pushed toward the extension part 89, the extension part 89 is rotated about the shaft 891 away from the fastening body 75. As a result, the fastening body 75 is moved into the space P defined between the first stopper 611 and the support body 87 (i.e. the space defined between the first stopper and the second stopper).

When the fastening body 75 is moved into the space P defined between the first stopper 611 and the second stopper 811 and 831, the protrusion 53 of the holder H moves between the transfer part 95 and the fastening body 75, with the result that the protrusion 53 is in the state shown in FIG. 6. In the present invention, therefore, it is possible to couple the holder H and the coupling unit C even when the fastening body 75 is separated from the first stopper 611.

Meanwhile, the first stopper 611 may be further provided with a location part 613 for supporting a free end of the extension part 89. The location part 613 is a means for preventing the extension part 89 from rotating toward the lower surface through hole 621, which is provided in the lower surface of the housing.

A first hole 615 for supporting the upper end of the support body 87 may be further provided in the upper surface 61 of the housing as another means for preventing the extension part 89 from rotating toward the lower surface through hole 621.

The extension part 89 may be further provided with a fastening body push part 88 for preventing the fastening body 75 from being withdrawn from the receiving recess 54 of the holder.

As shown in FIG. 6, the fastening body push part 88 protrudes from the lower surface of the extension part 89 (i.e. the surface of the extension part that faces the fastening body). When the fastening body 75 is separated from the first stopper 611, the fastening body push part 88 pushes the fastening body 75 toward the receiving recess 54 of the holder.

The extension part 89 is kept in contact with the location part 613 by the first elastic member 77, and the fastening body push part 88 remains in contact with the upper end of the fastening body 75. In the lock H and C according to the present invention, therefore, it is possible to prevent the fastening body 75 from being separated from the receiving recess 54 of the holder H unless external force is applied to the door 16 in the state in which the door 16 to the introduction port 111 is closed.

The housing may be further provided in the upper surface 61 thereof with a second hole 617 for preventing the free end of the extension part 89 from interfering with the upper surface of the housing when the extension part 89 is rotated.

In addition to the first plate 81 and the second plate 83, the housing 6 may further include an elastic member guide 64 for guiding the movement of the first elastic member 77. As shown in FIG. 2, the elastic member guide 64 may be located above the respective plates 81 and 83.

Meanwhile, in the lock H and C having the above structure, when the fastening body 75 is separated from the first stopper 611, the fastening body 75 collides with the second stopper 811 and 831 to generate a sound signal indicating that the fastening body 75 has been separated from the first stopper 611. Consequently, the user may confirm that the introduction port 111 has been closed by the door 16 based on the sound signal generated when the fastening body 75 collides with the second stopper 811 and 831.

The magnitude of the sound signal indicating that the door has been closed may be set as high as possible. In this case, however, the fastening body 75 or the second stopper 811 and 831 may be damaged. For this reason, the magnitude of the sound signal may be appropriately adjusted.

The sound signal generated when the fastening body 75 collides with the second stopper 811 and 831 is set depending on restoring force of the first elastic member 77. In the lock according to the present invention, it is difficult to reduce the restoring force of the first elastic member 77. Consequently, the lock may include a separate shock absorbing means for reducing the magnitude of the sound single generated when the fastening body 75 collides with the second stopper 811 and 831.

FIG. 8 shows an example in which a damper 84 is provided at the second stopper 811 and 831 or the support unit 8 as a separate shock absorbing means.

As previously described, the fastening body 75 collides with the second stopper 811 and 831 when the fastening body 75 is separated from the first stopper 611 by the transfer part 95. At this time, a sound signal is generated. Therefore, in the case in which a damper (e.g. a first damper) 84 for absorbing a portion of the impact generated when the fastening body 75 collides with the second stopper 811 and 831 is provided at the second stopper 811 and 831, it is possible to prevent damage to the fastening body or the second stopper and to prevent an excessive increase in the magnitude of the sound signal generated when the fastening body collides with the second stopper.

The material for the damper 84 is not particularly restricted as long as the damper can perform the above function. For example, the damper 84 may be made of rubber.

An embodiment shown in the upper part of FIG. 8 is characterized in that it is possible to prevent the fastening body 75 from colliding with the second stopper 811 and 831. A damper (e.g. a second damper) 84 according to this embodiment is provided at the support body 87. That is, the damper 84 according to this embodiment may be fixed to the lower part of the extension part 89 via a receiving part 82.

The fastening body 75, separated from the first stopper 611, is located below the extension part 89, which is provided at the support part. In the case in which the support part 7 is provided with a damper 84 for maintaining a predetermined distance between the fastening body and the second stopper 811 and 831, therefore, it is possible to prevent the fastening body 75 from colliding with the second stopper 811 and 831.

Meanwhile, in the case in which the lock according to the present invention is provided at a home appliance, such as a dishwasher 100, the dishwasher 100 may further include a gasket 17 for sealing the introduction port 111 when the door 16 is closed.

The gasket 17 is a means for preventing air or water from leaking out of the tub 11 through the introduction port 111 when the door 16 to the introduction port 111 is closed.

To this end, as shown in FIG. 9, a gasket fixing part 113, to which the gasket 17 is fixed, may be provided in the tub 11. The gasket fixing part 113 may protrude from the inner circumferential surface of the tub 11 and may then be bent toward the door 16.

In this case, the gasket fixing part 113 defines a communication hole 115, through which the introduction port 11 communicates with the interior of the tub 11. Consequently, the user may withdraw the racks 191 and 193, disposed in the tub 11, out of the tub through the communication hole 115.

In the case in which the communication hole 115 is defined by the gasket fixing part 113, the door 16 may include a first door body 161 defining the external appearance of the dishwasher, a second door body 163 fixed to the first door body and protruding toward the communication hole 115, and a closing surface 167 provided at the second door body for closing the communication hole 115 when the first door body closes the introduction port 11. In this case, the holder H may be provided at the upper surface 1631 of the second door body 163.

As shown in FIG. 8, the gasket 17 may include a fixed part 171 configured to be inserted into the gasket fixing part 113 and a sealing part 173 provided at the fixed part and disposed between the second door body 163 and the communication hole 115.

In the dishwasher having the above structure, when the first door body 161 closes the introduction port 11, the closing surface 167, provided at the second door body, closes the communication hole 115, and the sealing part 173 is compressed between the closing surface 167 and the communication hole 115. Consequently, air or water is prevented from leaking out of the tub 11.

Meanwhile, in order to prevent the sealing part 173 from being damaged by the lock H and C according to the present invention, the range in which the transfer part 95, provided at the lock, is movable must be set such that the transfer part 95 cannot contact the sealing part 173.

The holder H is located at the upper surface 1631 of the second door body, and the transfer part 95, which is provided at the coupling unit C, is configured to be moved from the introduction port 111 toward the communication hole 115 by the protrusion 53 of the holder when the introduction port 111 is closed. In the case in which the range in which the transfer part 95 is movable is set beyond the upper surface 1631 of the second door body, therefore, the transfer part 95 may contact the sealing part 173 when the door 16 to the introduction port 111 is closed, with the result that the sealing part 173 may be damaged. Consequently, the range in which the transfer part 95 is movable is set to be within the space defined between the first door body 161 and the closing surface 167, provided at the second door body.

FIG. 10 shows an example of a home appliance having a sensing unit for determining whether the door 16 to the introduction port 111 is closed. The sensing unit provided in this embodiment may include a first sensing unit S1 and a second sensing unit S2.

The first sensing unit S1 may include a first magnet S11 provided at the door 16 and a first signal generator S13 provided at the cabinet 1 for generating an electrical signal when the magnetic force of the first magnet is sensed. The second sensing unit S2 may include a second magnet S21 provided at the door 16 and a second signal generator S23 provided at the cabinet 1 for generating an electrical signal when the magnetic force of the second magnet is sensed.

The first signal generator S13 may generate an electrical signal when the first magnet S11 is located within a predetermined range, and may transmit the electrical signal to a controller (not shown). The second signal generator S23 may generate an electrical signal when the second magnet S21 is located within a predetermined range, and may transmit the electrical signal to the controller (not shown). That is, upon determining that the magnitude of magnetic force generated by the respective magnets S11 and S12 is a predetermined reference magnetic force or higher, the first signal generator S13 and the second signal generator S23 may generate electrical signals and transmit the electrical signals to the controller.

The sensing unit may include any one selected from between a first sensing unit S1 and a second sensing unit S2. In the case in which two sensing units are provided, as shown in FIG. 10, it is possible for the controller to determine whether the introduction port 111 is open or closed even when one of the sensing units malfunctions.

Meanwhile, in the case in which the sensing unit is provided at the dishwasher, the controller may control the dishwasher depending on whether the door 16 to the introduction port 111 is closed. That is, the controller may perform control such that the pump 4 or the steam supply unit 25 is operated only when the introduction port 111 is closed by the door 16. Furthermore, in the case in which the introduction port 111 is not closed, the controller may inform the user thereof through an alarm unit (e.g. a speaker or a display unit).

The first sensing unit S1 and the second sensing unit S2 shown in FIG. 10 are configured to determine whether the door to the introduction port 111 is closed. Alternatively, one of the first and second sensing units S1 and S2 may be configured to determine whether the door to the introduction port is closed, and the other of the first and second sensing units may be configured to determine whether the fastening unit 7 has been operated.

The above configuration is provided in consideration of the case in which the fastening body 75 is separated from the first stopper 611 even when the door 16 has not closed the introduction port 111, as previously described with reference to FIG. 7. In this case, the controller may determine, using one of the first and second sensing units, whether the introduction port 111 is open or closed, and may determine, using the other of the first and second sensing units, whether the fastening unit has been operated. In the case in which the fastening body 75 is separated from the first stopper 611 by external force, therefore, the controller may inform the user thereof using the alarm unit (not shown).

That is, in the case in which both the first sensing unit S1 and the second sensing unit S2 transmit electrical signals, the controller may determine that the door to the introduction port 1121 is closed normally. In the case in which only one of the sensing units S1 and S2 transmits electrical signals, however, the controller may inform the user that the door to the introduction port is not closed normally using the alarm unit.

The sensing unit for determining that the fastening unit 7 has been operated may include a magnet provided on at least one selected from between the first body 71 and the second body 74 of the fastening unit 7 and a signal generator for sensing the magnetic force of the magnet and generating an electrical signal when the fastening body 75 is separated from the first stopper 611.

Alternatively, the sensing unit for determining that the fastening unit 7 has been operated may include a magnet provided on at least one selected from between the first slide 91 and the second slide 94 and a signal generator for sensing the magnetic force of the magnet an generating an electrical signal when the slides 91 and 94 move such that the fastening body 75 is separated from the first stopper 611.

FIG. 11 shows another embodiment of the sensing unit. The sensing unit according to this embodiment is characterized in that the sensing unit includes a first sensing unit S1 for determining whether the fastening unit 7 has been operated and a second sensing unit S2 for determining whether the door to the introduction port 111 is closed.

The first sensing unit S1 of this embodiment may include a first case S15 fixed to the cabinet 1 or the housing 6, a first switch S19 provided in the first case for generating an electrical signal, and a first push part S17 contacting at least one of the first and second bodies 71 and 74 to operate the first switch S19 when the fastening body 75 is separated from the first stopper 611.

When the fastening body 75 is separated from the first stopper 611, therefore, the first push part S17 operates the first switch S19, and the first switch S19 generates and transmits an electrical signal to the controller, whereby the controller may determine whether the fastening unit 7 has been operated.

The second sensing unit S2 of this embodiment may be identical to the second sensing unit of the embodiment shown in FIG. 10. That is, the second sensing unit S2 of this embodiment may include a second magnet S21 provided at the door 16 and a second signal generator S23 provided at the cabinet 1 for sensing the magnetic force of the second magnet.

When the second magnet S21 is located within a predetermined range, the second signal generator S23 may generate an electrical signal, and may transmit the electrical signal to the controller (not shown).

Meanwhile, the second sensing unit S2 shown in FIG. 11 may have the same structure as the first sensing unit S1. In this case, the second sensing unit S2 may include a second case fixed to the cabinet 1 or the housing 6, a second switch provided in the second case for generating an electrical signal, and a second push part contacting the door to operate the second switch when the door to the introduction port 111 is closed.

Upon receiving the electrical signals from the first sensing unit S1 and the second sensing unit S2, therefore, the controller may determine that the door to the introduction port 111 is closed normally. Upon receiving the electrical signals from only one of the sensing units S1 and S2, on the other hand, the controller may inform the user that the door to the introduction is not closed normally using the alarm unit.

FIGS. 12 and 13 show a further embodiment of the sensing unit. The sensing unit according to this embodiment includes a first sensing unit S1 for determining whether the fastening unit 7 has been operated and a second sensing unit S2 for determining whether the door 16 to the introduction port 111 is closed.

The first sensing unit S1 of this embodiment is characterized in that whether the fastening unit 7 has been operated is determined based on whether the slides 91 and 94 have moved.

The first sensing unit S1 may include a first case S15 fixed to the cabinet 1 or the housing 6, a first push part S17 configured to be pushed by the slides 91 and 94 when the slides move such that the fastening body 75 is separated from the first stopper 611, and a first switch S19 provided in the first case for generating an electrical signal when the first push part S17 contacts the slides 91 and 94.

The first push part S17 may be configured to sense the position of at least one of the first and second slides 91 and 94. FIG. 12 shows an example in which, when the first slide 91 moves such that the fastening body 75 is separated from the first stopper 611, the first push part S17 contacts the first slide 91, and the first switch S19 generates an electrical signal in response to the contact between the first push part S17 and the first slide 91.

As shown in FIG. 13, the second sensing unit S2 of this embodiment may include a sensing body S22 configured to reciprocate in the housing 6, a protruding body S24 inserted into a slit 623 formed through the housing 6, one end of the protruding body being located outside the housing 6 and the other end of the protruding body being fixed to the sensing body S22, a body support part S28 for pushing the sensing body S22 toward the introduction port 111 (i.e. to the front surface of the housing), a contact part S26 protruding from the sensing body S22, a second case S25 (see FIG. 12) fixed to the cabinet 1 or the housing 6, a second push part S27 configured to be pushed by the contact part S26 when the door 16 is moved to the position at which the introduction port 111 is closed, and a second switch S29 provided in the second case S25 for generating an electrical signal when the second push part S27 contacts the sensing body S22.

When the door 16 to the introduction port 111 is closed, therefore, the protruding body S24 moves away from the introduction port 111 together with the second door body 163, and the sensing body S22 is moved to the rear of the housing 6 by the protruding body S24. While the sensing body S22 is moved to the rear of the housing 6, the contact part S26 contacts the second push part S27, and the second switch S29 transmits an electrical signal to the controller in response to the contact between the second push part S27 and the sensing body S22. Consequently, the controller may determine, using the second sensing unit S2, whether the door 16 to the introduction port 111 is closed.

As is apparent from the above description, the present invention has the effect of providing a lock configured such that force that a user is required to apply to a door in order to close an introduction port is smaller than force that the user is required to apply to the door in order to open the introduction port and a home appliance having the same.

In addition, the present invention has the effect of providing a lock including a holder and a fastening unit provided respectively at a cabinet having therein an introduction port and a door for opening and closing the introduction port and a home appliance having the same.

In addition, the present invention has the effect of providing a lock that is capable of preventing dislocation of a fastening unit, which is separably coupled to a holder, and a home appliance having the same.

In addition, the present invention has the effect of providing a lock that is capable of performing a function of fixing a door to a cabinet even when a fastening unit is dislocated and a home appliance having the same.

In addition, the present invention has the effect of providing a lock configured such that a holder and a fastening unit can be easily coupled to each other and such that the fastening unit is prevented from being separated from the holder when the holder and the fastening unit are coupled to each other and a home appliance having the same.

In addition, the present invention has the effect of providing a lock configured such that a holder and a fastening unit can be coupled to each other when the fastening unit moves to a position where the fastening unit is coupled to the holder even when a door to an introduction port is not closed and a home appliance having the same.

In addition, the present invention has the effect of providing a lock that is capable of generating a sound signal informing a user that the door to the introduction port is closed when the door to the introduction port is closed and a home appliance having the same.

In addition, the present invention has the effect of providing a lock that is capable of preventing an excessive increase in the magnitude of a sound signal generated when a door to an introduction port is closed and a home appliance having the same.

In addition, the present invention has the effect of providing a lock including a sensing unit for determining whether a door is closed and a home appliance having the same.

In addition, the present invention has the effect of providing a lock including a sensing unit for determining whether a fastening unit is coupled to a holder and whether a door to an introduction port is closed and a home appliance having the same.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lock for separably fixing a door to a cabinet having an introduction port therein, the lock comprising:

a holder adapted to be provided at one of the cabinet or the door;

a housing adapted to be provided at the other of the cabinet or the door;

a first stopper included in the housing;

an actuation unit to reciprocate in the housing, the actuation unit being moved away from the introduction port by the holder when the door to the introduction port is closed;

a fastening unit supported by the first stopper, the fastening unit being separated from the first stopper and coupled to the holder when the actuation unit is moved away from the introduction port;

a first elastic member for providing force necessary to move the fastening unit away from the introduction port; and a second elastic member for providing force necessary to move the actuation unit toward the introduction port, wherein the fastening unit comprises:

a fastening body separably provided at the first stopper, the fastening body being coupled to the holder when separated from the first stopper; and a first body and a second body extending from opposite ends of the fastening body in a direction away from the introduction port, wherein the actuation unit comprises:

a first slide and a second slide to reciprocate in a movement direction of the holder, the first slide and the second slide being spaced apart from each other, defining a space for receiving the first body and the second body;

a transfer part for connecting the first slide and the second slide, the transfer part being configured to be moved away from the introduction port by the holder; and a body push part provided on at least one of the first slide and the second slide for contacting the first body and the second body depending on a position of the transfer part to separate the fastening body from the first stopper.

2. The lock of claim 1, wherein the first elastic member remains compressed when the fastening body is supported by the first stopper and moves the fastening body away from the introduction port when the fastening body is separated from the first stopper, wherein the second elastic member is compressed by at least one of the first slide and the second slide while the actuation unit moves to a position at which the fastening body is separated from the first stopper, and wherein the force necessary to compress the first elastic member is set to be larger than the force necessary to compress the second elastic member.

3. The lock of claim 2, further comprising:

a second stopper provided at the housing for limiting movement of the fastening body when the fastening body is separated from the first stopper.

4. The lock of claim 3, further comprising:

a first plate and a second plate located in a space defined between the first body and the second body for providing a space for receiving the first elastic member, wherein the second stopper comprises at least one of one surface of the first plate, which faces the first stopper, and one surface of the second plate, which faces the first stopper.

5. The lock of claim 4, further comprising:

a support body rotatably fixed to the first plate and the second plate; and an extension part extending from the support body toward the first stopper, wherein one end of the first elastic member is fixed to the support body and the other end of the first elastic member is fixed to at least one of the first body and the second body, and wherein the second stopper supports the fastening body, separated from the first stopper, below the extension part.

6. The lock of claim 5, further comprising at least one of:

a first damper provided at one of the fastening body and the second stopper for absorbing impact generated when the fastening body collides with the second stopper; and a second damper fixed to the support body for preventing the fastening body from colliding with the second stopper.

7. The lock of claim 5, wherein the first stopper comprises a location part for supporting a free end of the extension part to prevent the free end of the extension part from rotating toward a lower surface of the housing.

8. The lock of claim 1, wherein the body push part comprises at least one of:

a first body push part provided at the first slide for pushing the first body such that the fastening body is separated from the first stopper when the transfer part is moved away from the introduction port; and a second body push part provided at the second slide for pushing the second body such that the fastening body is separated from the first stopper when the transfer part is moved away from the introduction port.

9. The lock of claim 8, further comprising at least one of:

a first body incline provided at the first body, the first body incline being inclined upward away from the introduction port, the first body incline contacting the first body push part when the transfer part is moved away from the introduction port; and a second body incline provided at the second body, the second body incline being inclined upward away from the introduction port, the second body incline contacting the second body push part when the transfer part is moved away from the introduction port.

10. The lock of claim 1, further comprising:

a first receiving part provided at the housing for defining a movement path of the first slide; and a second receiving part provided at the housing for defining a movement path of the second slide.

11. The lock of claim 10, wherein the second elastic member comprises at least one of:

a first spring provided in the first receiving part for pushing the first slide toward the introduction port; and a second spring provided in the second receiving part for pushing the second slide toward the introduction port.

12. The lock of claim 1, further comprising:

a first bar extending through the first slide for guiding movement of the first slide; and a second bar extending through the second slide for guiding movement of the second slide, wherein the second elastic member comprises at least one of:

a first spring, into which the first bar is inserted, for pushing the first slide toward the introduction port; and a second spring, into which the second bar is inserted, for pushing the second slide toward the introduction port.

13. The lock of claim 1, further comprising:

a first magnet provided at one of the door or the cabinet;

a first signal generator provided at the other of the door or the cabinet for sensing magnetic force of the first magnet and generating an electrical signal when the door to the introduction port is closed;

a second magnet provided at one of the door or the cabinet, the second magnet being spaced apart from the first magnet in a state in which the housing is located between the first magnet and the second magnet; and a second signal generator provided at the other of the door or the cabinet for sensing magnetic force of the second magnet and generating an electrical signal when the door to the introduction port is closed.

14. The lock of claim 1, further comprising:

a first sensing unit for determining whether the fastening body is separated from the first stopper; and a second sensing unit for determining whether the door to the introduction port is closed.

15. The lock of claim 14, wherein the first sensing unit comprises:

a first push part to contact at least one of the first body and the second body when the fastening body is separated from the first stopper; and a first switch for generating an electrical signal when the at least one of the first body and the second body contacts the first push part.

16. The lock of claim 14, wherein the first sensing unit comprises:

a first push part to contact at least one of the first slide and the second slide when the actuation unit moves to a position at which the fastening body is separated from the first stopper; and a first switch for generating an electrical signal when the at least one of the first slide and the second slide contacts the first push part.

17. The lock of claim 14, wherein the second sensing unit comprises:

a magnet provided at one of the door or the cabinet; and a signal generator provided at the other of the door or the cabinet for sensing magnetic force of the magnet and generating an electrical signal when the door to the introduction port is closed.

18. The lock of claim 14, wherein the second sensing unit comprises:

a sensing body to reciprocate in the housing;

a protruding body to contact the door to move the sensing body away from the introduction port when the door is moved in a direction in which the introduction port is closed;

a body support part for providing force necessary to move the protruding body toward the introduction port;

a second push part to contact the sensing body when the door to the introduction port is closed; and a second switch for generating an electrical signal when the sensing body contacts the second push part.

19. A home appliance comprising:

a cabinet having an introduction port therein;

a tub provided in the cabinet for defining a space for receiving objects to be stored;

a communication hole, through which the tub communicates with the introduction port;

a door comprising a first door body for opening and closing the introduction port, a second door body protruding from the first door body toward the tub, and a closing surface provided at the second door body for closing the communication hole when the first door body closes the introduction port;

a sealing part provided along an edge of the communication hole, the sealing part being compressed between the closing surface and the edge of the communication hole when the first door body closes the introduction port;

a holder provided at the door;

a housing provided at the cabinet;

a first stopper included in the housing, the first stopper being located between the introduction port and the communication hole;

a fastening unit separably supported by the first stopper, the fastening unit being coupled to the holder when separated from the first stopper;

an actuation unit to reciprocate in the housing, the actuation unit being moved toward the communication hole in a state of contacting the holder when the first door body is moved in the direction in which the introduction port is closed, the actuation unit being configured to separate the fastening unit from the first stopper while the actuation unit is moved toward the communication hole;

a first elastic member for providing force necessary to move the fastening unit away from the introduction port; and a second elastic member for providing force necessary to move the actuation unit toward the introduction port, wherein the fastening unit comprises:

a fastening body separably provided at the first stopper, the fastening body being coupled to the holder when separated from the first stopper; and a first body and a second body extending from opposite ends of the fastening body in a direction away from the introduction port, wherein the actuation unit comprises:

a first slide and a second slide to reciprocate in a movement direction of the holder, the first slide and the second slide being spaced apart from each other, defining a space for receiving the first body and the second body;

a transfer part for connecting the first slide and the second slide, the transfer part being configured to be moved away from the introduction port by the holder; and a body push part provided on at least one of the first slide and the second slide for contacting the first body and the second body depending on a position of the transfer part to separate the fastening body from the first stopper.

* * * * *